United States Patent [19]

Zickos

[11] 3,945,291

[45] Mar. 23, 1976

[54] DRUM CONSTRUCTION

[76] Inventor: William T. Zickos, 10212 W. 96th Terrace, Overland Park, Kans. 66212

[22] Filed: Feb. 27, 1975

[21] Appl. No.: 553,650

Related U.S. Application Data

[62] Division of Ser. No. 511,217, Oct. 2, 1974.

[52] U.S. Cl. ..... 84/421; 403/391

[51] Int. Cl.[2] ..... G10G 5/00

[58] Field of Search ..... 84/421; 403/391

[56] References Cited

UNITED STATES PATENTS

| | | | |
|---|---|---|---|
| 1,057,658 | 4/1913 | Nichols | 403/391 |
| 1,677,376 | 7/1928 | Zilliox | 403/391 |
| 2,745,181 | 5/1956 | Czerniewicz | 403/391 X |
| 3,025,089 | 3/1962 | Ramsden | 403/391 |

FOREIGN PATENTS OR APPLICATIONS

| | | | |
|---|---|---|---|
| 645,070 | 10/1950 | United Kingdom | 84/421 |

*Primary Examiner*—Lawrence R. Franklin
*Attorney, Agent, or Firm*—Lowe, Kokjer, Kircher, Wharton & Bowman

[57] ABSTRACT

A kettle-shaped drum has an annular recess adjacently below the top end of its hollow body. The flexible drum head includes a peripheral rib disposed in the recess and engaged at the top by a bracket. A plurality of recessed tensioning screws that extend downwardly from the bracket are threaded into a shoulder beneath the recess to permit adjustment of the head tension.

A framework for supporting a drum assembly includes a series of elongate frame members that are interconnected by a plurality of identical joints. Each component of the drum assembly is supported on a rod which is in turn received by a joint mounted on one of the frame members. The construction of the joints permits the frame members to be assembled in any desired arrangement and also permits universal positioning of the drum assembly.

2 Claims, 5 Drawing Figures

DRUM CONSTRUCTION

This is a division, of application Ser. No. 511,217, filed Oct. 2, 1974.

BACKGROUND AND SUMMARY OF THE INVENTION

This invention relates to an improved drum construction and also to a framework for supporting the components of a drum assembly.

The tension in the head of a drum is of great importance because the pitch of the instrument is determined by the head tension. In order to permit adjustment of the tension in the drum head, conventional drums are provided with a flange or lug that projects outwardly near the top of the drum body to present an area for receiving screws or similar adjustable tensioning devices. This conventional arrangement detracts considerably from the appearance of the drum since the flange and the unsightly screws are located in particularly noticeable positions outwardly of the drum body. In addition, a substantial interference problem is presented when it is desired to position a number of drums in close proximity to one another. Adjacent drums must be separated far enough to provide sufficient clearance between the respective flanges and permit access to the tensioning screws. Consequently, the drums must be spaced apart farther than most drummers would prefer.

The conventional manner in which drum assemblies are supported has further added to the problem of obtaining a desirable spacial relationship among the various components. Specifically, the supports currently used to mount drums and associated instruments such as cymbals typically lack a means for universally positioning each individual instrument. This deficiency has been particularly serious because each drummer has his own personal preference as to the exact spacing, height, and angular orientation of the components of the drum assembly. Furthermore, conventional drum supports are generally lacking in stability and structural strength, as well as requiring considerable time and difficulty to assemble and dismantle.

In view of the foregoing deficiencies in the prior art, it is an object of the present invention to provide a drum having adjustable tensioning devices that are recessed inwardly of the drum body. The attainment of this important object eliminates the outwardly projecting flange or lug associated with existing drums and permits adjacent drums to be positioned more closely together. Also, due to their recessed location, the screws cannot become accidentally engaged and moved out of adjustment.

In conjunction with the preceding object, it is another object of the invention to provide a drum having an improved appearance. The novel drum construction provided by the instant invention locates the tensioning screws in a recessed position where they are not as noticeable as in existing drums.

Still another object of the invention is to provide a drum having improved strength and rigidity. The normally weak top portion of the drum is recessed inwardly from the remainder of the drum body and is structurally reinforced by a horizontal shoulder and a short vertical wall.

Yet another object of the invention is to provide a structurally improved drum support for the components of a drum assembly.

A further object of the invention is to provide a drum support that permits independent and universal positioning of each component of a drum assembly. It is a particular feature of the invention that the drums and cymbals may be set at any desired horizontal, vertical and angular position.

A still further object of the invention is to provide a drum support of the character described that may be quickly and easily assembled and disassembled.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith, and in which like reference numerals are employed to indicate like parts in the various views.

Figure 1:
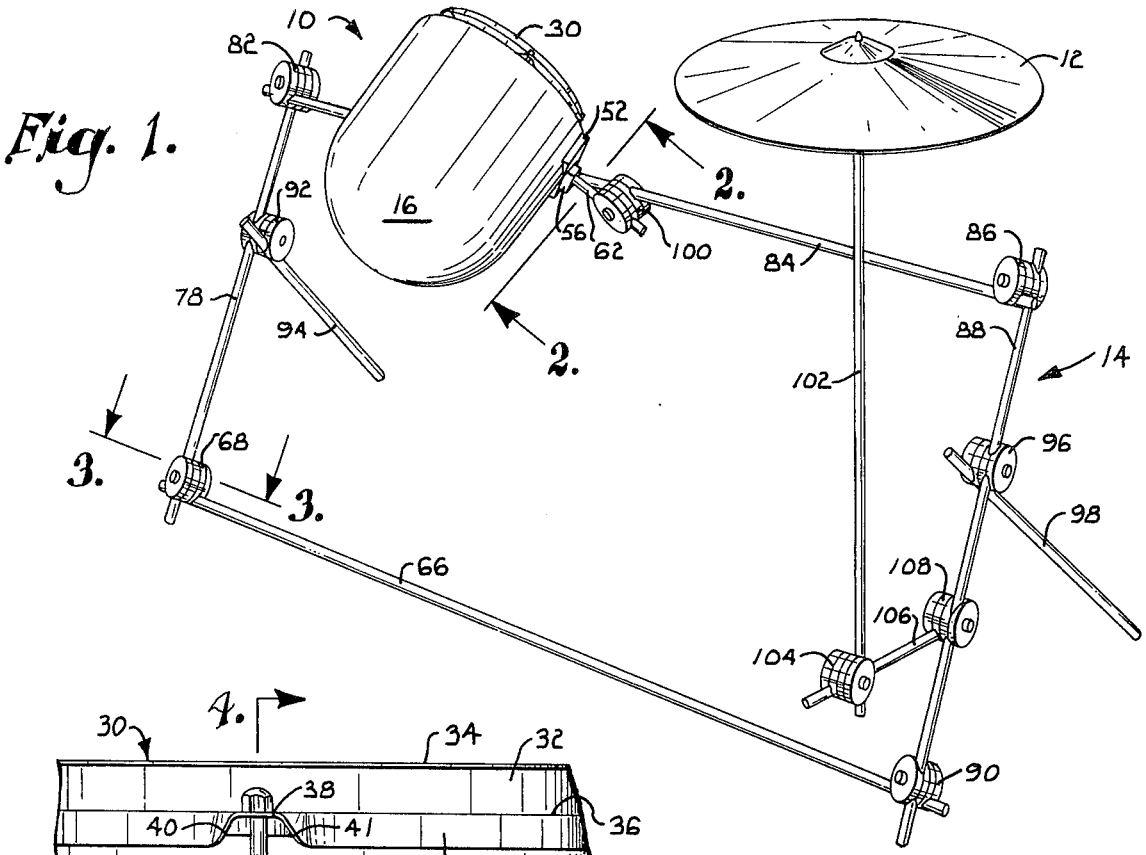
FIG. 1 is a perspective view of a drum supporting framework embodying the invention, with a kettle-shaped drum constructed in accordance with the invention and a cymbal supported thereon.
Figure 2:
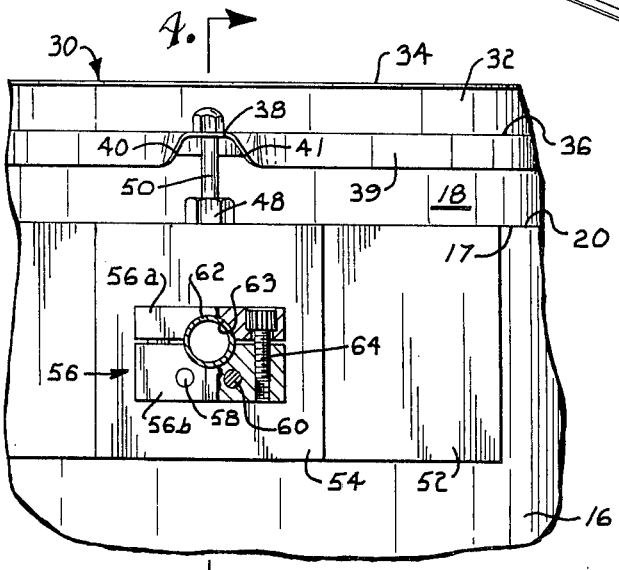
FIG. 2 is an enlarged, fragmentary elevational view of one side of the drum taken generally along line 2—2 of FIG. 1 in the direction of the arrows.
Figure 4:
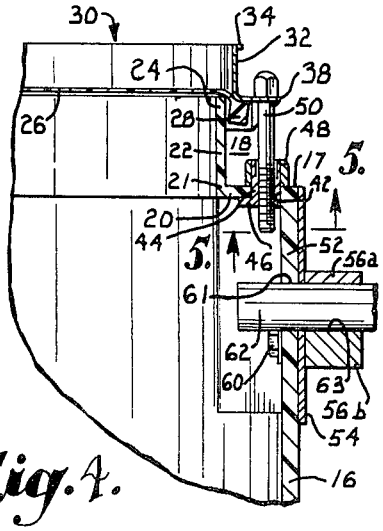
FIG. 4 is a fragmentary cross-sectional view taken generally along line 4—4 of FIG. 2 in the direction of the arrows.

Referring now to the drawing in detail, FIG. 1 illustrates a drum 10 and a cymbal 12 supported on a framework which is generally designated by reference numeral 14. With initial reference to the construction of drum 10, the majority of the drum body is formed by a hollow shell 16. Shell 16 is of generally kettle or bowl-shaped configuration and is preferably constructed of fiberglass or a similar material possessing adequate strength and suitable acoustical properties. Referring particularly to FIGS. 2 and 4, the top of the bowl-shaped shell 16 presents a circular periphery 17, above which an annular recess 18 is formed in the drum body. A flat, horizontal shoulder 20 of annular configuration extends inwardly from periphery 17. Shoulder 20 curves entirely around the drum body in a horizontal disposition to present a flat, upwardly facing surface at the underside of recess 18. The annular shoulder 20 terminates inwardly in a circular edge 21 which is concentric with periphery 17 and disposed inwardly thereof. A short vertical wall 22 extends upwardly from the inward circular edge 21 of shoulder 20 to define the inward side of recess 18. Wall 22 curves in a circular manner entirely around the drum body at an inwardly recessed location relative to periphery 17. Wall 22 terminates upwardly in a circular peripheral edge 24 that extends around the open top end of the drum body. It is pointed out that the structural reinforcement provided by the horizontal shoulder 20 and the recessed vertical wall 22 adds considerable strength and rigidity to the top end of the drum body, which is normally the structurally weakest part of a drum having a kettle shape.

A flexible drum head 26 is drawn tightly over the open top end of shell 16. An enlarged peripheral rib 28 of substantially square cross section is formed integrally with head 26 and extends entirely around the circular periphery thereof. Rib 28 is disposed in the top portion of recess 18. Peripheral edge 24 engages the underside of head 26 slightly inwardly of rib 28, while a corner of the rib engages wall 22 somewhat below the top end of the wall.

A circular, ring-like bracket 30 forms the rim of drum 10. Bracket 30 is of slightly greater diameter than the top end of the drum body and is positioned outwardly of edge 24 in continuous engagement with the top of rib 28 to maintain the tension in head 26. Bracket 30 includes an upper wall section 32 which extends vertically above edge 24 and which curves entirely around the drum body slightly outwardly of edge 24. Wall section 32 terminates upwardly in a small outwardly projecting lip 34. An integral shoulder 36 extends outwardly from the bottom edge of section 32 with its flat underside engaging the top of rib 28. Shoulder 36 is disposed horizontally in the top portion of recess 18 and is spaced upwardly from shoulder 30 in parallel relation thereto.

A plurality of integral lugs 38 extend horizontally outwardly from the outer edge of shoulder 36. Lugs 38 are spaced equally from one another around bracket 30. A vertical skirt 39 (FIG. 2) forms the bottom section of bracket 30. Skirt 39 extends downwardly from the outer edge of shoulder 36 and is spaced slightly outwardly of rib 28 to cover same. A pair of gussets 40 and 41 (FIG. 2) are formed integrally with each lug 38 on the respective opposite sides thereof. Gussets 40 and 41 angle downwardly and inwardly from each lug 38 to integrally join with skirt 39 and thereby structurally reinforce the lugs.

Figure 5:
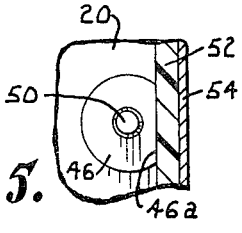
FIG. 5 is an enlarged, fragmentary horizontal cross-sectional view taken generally along line 5—5 of FIG. 4 in the direction of the arrows.

Each lug 38 is rounded on its outer edge, and an aperture is formed through each lug inwardly of the rounded edge. Lugs 38 are disposed horizontally in the upper portion of recess 18 and are spaced above shoulder 20 in parallel relation thereto. Directly below the aperture in each lug 38, an aperture 42 is formed through shoulder 20. A small bolt 44 having an enlarged head 46 is fitted in each shoulder aperture 42. The enlarged head 46 of each bolt 44 is disposed below shoulder 20 in engagement with the underside thereof. A flat edge **46*a* (FIG. 5) is formed on each bolt head to engage the interior surface of shell 16 and prevent the bolt from turning. The shank of each bolt 44 is threaded to receive a nut 48 which is tightened against the top surface of shoulder 20.**

A screw 50 having an elongate shank is inserted through the aperture of each lug with the enlarged screw head engaging the top of the lug. Each bolt 44 is provided with a threaded central bore which receives the threaded shank of a corresponding screw 50. Each screw 50 may be tightened or loosened to respectively move bracket 30 a short distance toward or away from shoulder 20. Accordingly, the engagement of bracket shoulder 36 with the top of rib 28 causes either an increase or decrease in the tension in drum head 26, depending on the direction that screws 50 are turned.

In FIG. 1, it is seen that one side of shell 16 includes an integral rectangular boss 52 that projects outwardly adjacently below shoulder 20. A substantially square metal plate 54 is suitably fixed to the flat forward surface of boss 52 at a central location thereon. A rectangular mounting bracket 56 includes an upper section **56*a* and a lower section 56*b* which is spaced slightly below section 56*a*. Bracket 56 is secured to plate 54 by a pair of screws 58 and 60 which extend through boss 52 and plate 54 and are threaded into respective holes in lower bracket section 56*b*. The enlarged heads of screws 58 and 60 are located internally of shell 16 in engagement with the inside surface of boss 52.**

A circular opening 61 (FIG. 4) is formed through boss 52 and plate 54 to receive the end of a cylindrical rod 62. Bracket sections **56*a* and 56*b* are provided with respective semicircular openings which together define a circular opening 63 that is aligned with opening 61. Referring to FIG. 2, lower bracket section 56*b* is provided with a pair of threaded vertical holes, while upper section 56*a* is provided with a pair of vertical holes that are aligned thereabove. A screw 64 is freely inserted through each hole in section 56*a* and threaded into the aligned hole of section 56*b* to connect the two bracket sections. Section 56*a* preferably includes respective counterbored areas which permit the enlarged head of each screw 64 to be recessed. Screws 64 may be tightened to cause the two bracket sections 56*a* and 56*b* to firmly clamp rod 62 in opening 63 and thereby lock the rod in a desired position. It is noted that when screws 64 are loosened, drum 10 may be pivoted about the axis of rod 62** to any desired angular orientation.

Drum 10 may be of any desired size, including the relatively small size of conventional two-headed snare drums. It is contemplated that a plurality of these small drums 10 will be included in a multi-drum assembly, along with a considerably larger bass drum (not shown). As a result, the overall sound quality of the drum assembly will be enhanced due to the improved acoustical properties of kettle-shaped drums as compared to two headed drums.

In use, drum 10 is mounted on the end of rod 62, which is inserted into openings 61 and 63. After drum 10 is properly positioned on rod 62, screws 64 are tightened to lock the drum on the end of the rod by means of the engagement of bracket sections **56*a* and 56*b* with the rod. The tensioning screws 50 may be manipulated to adjust the tension in head 26 as desired. When screws 50 are threaded into bolt 44, bracket 30 is moved slightly downwardly. The movement imparted to shoulder 36 of the bracket, which bears against the top of rib 28, thereby exerts a downward force on rib 28 and tightens head 26. Conversely, if screws 50 are loosened, rib 28 is permitted to move upwardly, and the tension in head 26** is relaxed somewhat.

Figure 3:
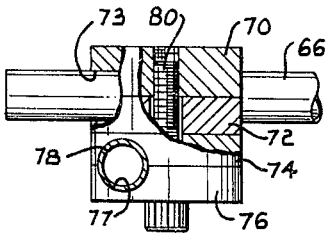
FIG. 3 is an enlarged, fragmentary view taken generally along line 3—3 of FIG. 1 in the direction of the arrows and showing a joint included in the framework, with portions of the joint broken away to more clearly illustrate the internal structure thereof.

Turning now to the construction of framework 14, an elongate cylindrical rod 66 (FIG. 1) is located near the floor in horizontal disposition. A joint 68 is received on rod 66 near its left end. With particular reference to FIG. 3, joint 68 includes a first pair of flat, circular discs 70 and 72 which are disposed adjacently to form one section of the joint. Each disc 70 and 72 has a blunt peripheral edge of circular configuration. Discs 70 and 72 have respective semicircular openings extending therethrough at a location offset from the center of the discs and in a direction that is perpendicular to an axis passing through the centers of the discs. The two semicircular openings cooperate to define a cylindrical opening 73 of a size to closely receive rod 66 therein. Another pair of adjacent discs 74 and 76 having blunt circular edges and flat opposite sides cooperate to form the second section of joint 68. Discs 74 and 76 are provided with respective semicircular openings which together define a cylindrical opening 77 extending through the discs in a direction perpendicular to a central axis and at a location offset from the center of the discs. The bottom end of a cylindrical rod 78 is extended through opening 77 and is preferably angled slightly with respect to vertical.

Discs 70, 72, 74 and 76 are of identical circumference and are disposed in a side-by-side or stacked relationship, with the flat sides of adjacent discs in engagement. The discs are provided with aligned central bores which form a continuous opening that is perpendicular to both of the cylindrical openings 73 and 77. A screw 80 is freely inserted through the central bores of discs 72, 74 and 76. Disc 70 is of slightly greater width than the other discs, while its bore is reduced in diameter and threaded to engage the threads on screw 80. Screw 80 may be tightened to lock the four discs against one another and also to firmly clamp rods 66 and 78 in the respective openings 73 and 77, thereby locking joint 68 at the desired position on the respective rods. It is noted that the utilization of circular discs 70, 72, 74 and 76 in the joint structures is particularly advantageous because no sharp edges are presented. It is further pointed out that the flat opposite sides of each circular disc present large surfaces to firmly grip against the flat side of an adjacent disc when screw 80 is tightened to lock the discs together. Moreover, discs having the disclosed construction tightly grip against the rods that are inserted in openings 73 and 77 due to the relatively large internal areas of the discs that bear against the rods that are disposed in said openings.

Referring again to FIG. 1, another joint 82 is received on rod 78 near the top end thereof. Joint 82 and all other joints referred to hereinafter are constructed identically to joint 68. An elevated horizontal rod 84 extends between joint 82 at its left end and another joint 86 at its right end. Another rod 88 extends downwardly from joint 86 and is preferably parallel to rod 78. Near its bottom end, rod 88 receives a joint 90 which is in turn received on the right end of rod 66.

A joint 92 is received on rod 78 above the center thereof. A leg 94 in the form of a cylindrical rod angles downwardly from joint 92 and engages the floor at its bottom end. Similarly, an intermediate portion of rod 88 receives a joint 96. A second leg 98 that is substantially parallel to leg 94 extends downwardly from joint 96 to engage the floor at its bottom end. Rods 78 and 88 cooperate with legs 94 and 98 to provide a stable base for framework 14, while rod 66 adds further stability and structural support.

The various components of the drum assembly are supported on framework 14 for universal positioning thereon. The rod 62 on which drum 10 is mounted has its opposite end received in a joint 100. Joint 100 is in turn received on rod 84 at an intermediate portion of the rod. Cymbal 12 is suitably mounted on the top end of a substantially vertical rod 102 which is received by a joint 104 at its bottom end. A short rod 106 extends from joint 104 to another joint 108 that is received on an intermediate portion of rod 88. It is contemplated that the actual drum assembly will include other components (not shown) which will be supported at various positions on the rigid framework structure by means of additional joints and rods. Preferably, the rods included in the framework structure comprise hollow tubes constructed of steel or a similar sturdy material.

In use, framework 14 may be easily assembled in the desired arrangement. For example, joint 68 may be adjusted to orient rods 66 and 78 at any desired angle with respect to one another. If screw 80 is loosened, discs 74 and 76 may be rotated together about the axis of screw 80 to dispose opening 77 at any selected angle relative to opening 73. In addition, the entire joint 68 may be rotated about the axis of rod 66 to position rod 78 in any desired plane, and joint 68 may also be rotated about the axis of rod 78. It is further pointed out that joint 68 may be slid longitudinally along either rod 66 or 78 to move the joint to any desired longitudinal position on the respective rods. It is noted that only a single adjustment is necessary in order to lock rods 66 and 78 in the desired positions, since the tightening of screw 80 immobilizes joint 68 and causes rods 66 and 78 to be tightly engaged and firmly held in position in the respective openings 73 and 77. When all of the joints of framework 14 are tightened, the framework is fixed in a rigid disposition to provide a sturdy, stable support for the drum assembly.

The components of the drum assembly may be similarly set at any desired position with respect to the framework members from which they are supported. With reference to FIG. 1, rod 62 may by pivoted about the axis of the central screw in joint 100 after the screw has been loosened. Also, joint 100 may be pivoted about rod 84, and rod 62 may be retracted or extended relative to joint 100 to move drum 10 toward or away from the joint. Drum 10 may be oriented at the desired angle either by rotating rod 62 within its receiving opening in joint 100 or by loosening bracket 56 and pivoting the drum about the axis of rod 62. Of course, cymbal 12 and the additional components of the drum assembly may be universally positioned with respect to framework 14 in a similar manner. A large bass drum (not shown) may be mounted on rod 66 by any convenient means which permits positional adjustment of the bass drum.

From the foregoing it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention I claim:

1. A framework for supporting a drum above a floor, said framework comprising:

a base engaging said floor;

at least one elongate frame member supported by said base and disposed upwardly of said floor;

a first joint member received on said frame member for selective pivotal and longitudinal movement with respect thereto, said first joint member including a pair of separable blocks having substantially flat surfaces positioned against one another, said blocks cooperating to present a bore through said first joint member of a size to closely receive said frame member;

a second joint member coupled to said first joint member at a location offset from said frame member, said second joint member being selectively pivotal with respect to said first joint member about a pivot axis oriented substantially perpendicular to said frame member, said second joint member including a pair of separable blocks having substantially flat surfaces positioned against one another, the blocks of said second joint member cooperating to present a bore through said second joint member, each block of each joint member being independently movable relative to the other blocks;

a rod member closely received in the bore of said second joint member in an orientation substantially perpendicular to said pivot axis, said rod member being selectively movable longitudinally and rotatively;

means for coupling said drum to said rod member at a location offset from said second joint member; and releaseable means for locking the blocks of said first and second joint members against said frame and rod members to retain the frame and rod members in place in said bores.

2. A framework as defined in claim 1, wherein each of said blocks comprises a disc member, each of said disc members having flat opposite sides and a blunt peripheral edge of substantially circular configuration.

* * * * *